United States Patent [19]

Nishi

[11] Patent Number: 4,592,496

[45] Date of Patent: Jun. 3, 1986

[54] GARMENT PATTERN FORM

[76] Inventor: Beatrice Y. Nishi, 161 7th Ave., San Francisco, Calif. 94118

[21] Appl. No.: 757,181

[22] Filed: Jul. 16, 1985

Related U.S. Application Data

[63] Continuation of Ser. No. 547,502, Oct. 31, 1983, abandoned.

[51] Int. Cl.[4] ..... A41H 5/00

[52] U.S. Cl. ..... 223/68

[58] Field of Search ..... 223/68

[56] References Cited

U.S. PATENT DOCUMENTS

| | | | |
|---|---|---|---|
| 1,160,420 | 11/1915 | Levin | 223/68 |
| 3,191,821 | 6/1965 | Levin et al. | 223/68 |
| 3,734,362 | 5/1973 | Arthur | 223/68 |
| 3,838,800 | 10/1974 | Arthur et al. | 223/68 |
| 4,179,152 | 12/1979 | Kent | 2/DIG. 6 |

FOREIGN PATENT DOCUMENTS

| | | | |
|---|---|---|---|
| 2064195 | 2/1980 | United Kingdom | 223/68 |

*Primary Examiner*—Louis K. Rimrodt

*Attorney, Agent, or Firm*—Townsend and Townsend

[57] ABSTRACT

A pattern form having adjustable members mounted on an upright post. The adjustable members represent the neck and shoulder region, the bust region, the waist region, and the hip region of the person for whom a garment is to be made. The neck and shoulder member can be adjusted as to size of the neck and the width and the angle of droop of the shoulders. The bust, waist and hip members can be adjusted as to the size and shape of the waist and hips. Pattern elements of pellon material are mounted on the adjustable members after the members have been adjusted to the size of the person for whom the garment is to be made. The pattern members define outer surfaces on which conventional tissue paper patterns can be pinned in the making of a garment. Changes in the adjustment of the adjustable members can be made to compensate for changes in the size of the person from time to time.

18 Claims, 10 Drawing Figures

GARMENT PATTERN FORM

This is a continuation of Ser. No. 547,502, filed Oct. 31, 1983, now abandoned.

BACKGROUND OF THE INVENTION

Conventional pattern forms for making garments have been known for many years. They have been made in fixed and adjustable sizes and have been mounted on upright stands so that the fabric to be used in making the garment can be mounted directly to the outer surface of the pattern form. Thus, the various segments of the fabric taken from the pattern itself can be pinned together, then removed from the pattern form and stitched to make the resulting garment.

Pattern forms of fixed sizes have a major drawback in that they do not allow for any adjustability in the size of a garment to be made from the fabric which is mounted on a pattern form. The reason for this is that the pattern form may be of the right size in the bust area but not the correct size in the hip and waist areas. This will require many changes in stitching of the garment along various seamlines, all of which requires considerable time and effort to complete. Even when a garment is finally finished, the garment still may not fit correctly because each of the many changes to one part of the garment must be made with changes to other parts of the garment taken into consideration. As a result, fixed pattern forms are not suitable for making garments for persons who differ even slightly in size and shape to the pattern form on which the garment is to be made.

Adjustable pattern forms have also been used considerably in the past. But, notwithstanding their adjustability, they still do not permit a garment to be made in a manner which requires few or no changes in the garment to fit the person. The reason for this is that adjustable pattern forms have a multitude of segmented body parts which are shiftably mounted on an upright stand and, as a unit, have outer surfaces which simulate the single, unitary body of a fixed pattern form except for the fact that the segmented body parts can be shifted about relative to each other for adjustment purposes. The various positions into which the body parts can be shifted must be eyeballed in such a way that the resulting size and shape of the pattern form must appear to look like the size and shape of the body of the person for whom the garment is to be made. This adjustment of the segmented body parts leaves much to be desired because, while the body parts might be properly adjustable in one area, such as in the waist area, the parts could be clearly out of adjustment in the hip and bust areas. Moreover, a slight force sometimes accidentally applied to one or more of these body parts can move them out of adjustment, and it is difficult to put them back into their proper positions. Thus, adjustable pattern forms also leave much to be desired and require much time and effort to be used properly.

Because of the foregoing drawbacks, a need has arisen for a pattern form which enables one to evaluate and make adjustments on tissue patterns before cutting and sewing fabrics and can be easily adjusted and can be used even by persons with only minimal skills in garment making.

SUMMARY OF THE INVENTION

The present invention fills the aforesaid need by providing an improved pattern form which is adjustable in a number of locations in a manner to simulate the actual measurements of the person for whom a garment is made. Specifically, the pattern form of the present invention has adjustable members in four locations, namely the neck and shoulder region, the bust region, the waist region and the hip region. These members are mounted on an upright post and adjustments to the members can be made quickly and easily after measurements of the person have been taken with a tape measure.

To complete the pattern form, pattern elements of a suitable, relatively self-sustaining material are mounted on the adjustable members secured to the post. This is done after the adjustable members have been properly adjusted on the post to the size of the person for whom a garment is to be made. The pattern elements represent a bodice, a skirt and optionally a pair of sleeves, and these pattern elements are mounted on the adjustable members, the skirt and sleeves being secured in any suitable manner, such as by snaps, Velcro, zippers or the like to the bodice. These pattern elements, when mounted on the adjustable members on the post, provide backing surfaces on which conventional tissue paper patterns are pinned or otherwise attached for actually making a garment from the pattern form itself. Preferred material for the pattern elements is pellon because it is washable, can be pressed, and is non-shrinkable. Even if it is crushed during storage, it can be pressed with a steam iron to remove the creases from it.

The primary object of the present invention is to provide an improved pattern form for making garments wherein the pattern form has a number of adjustable members presenting the neck and shoulder region, the bust region, the waist region and the hip region of a person for whom a garment is made so that, by first adjusting the members and then placing adjustable, pattern elements, such as a bodice, a skirt, and sleeves, on the adjustable members, a pattern form is constructed which truly represents in size and shape the actual body of the person for whom a garment is to be made.

Other objects of this invention will become apparent as the following specification progresses, reference being had to the accompanying drawings for an illustration of the invention.

Figure 1:
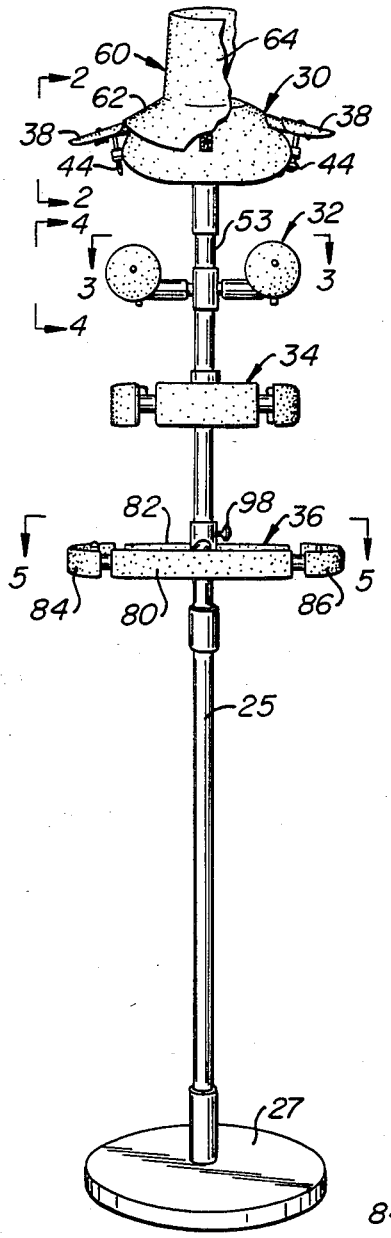
FIG. 1 is a perspective view of a post having adjustable members in the neck and shoulder, bust, waist, and hip regions for use in supporting adjustable pattern elements for making a pattern form.
Figure 2:
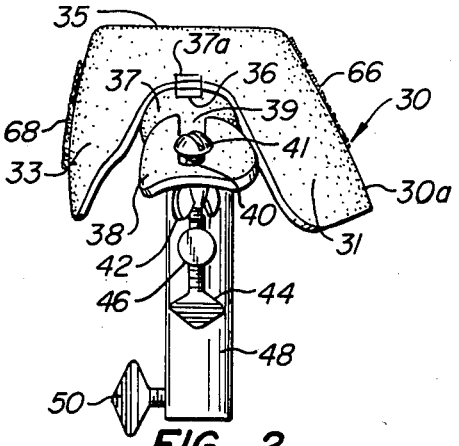
FIG. 2 is an enlarged, fragmentary side elevational view of the adjustable member for the neck and shoulder region.
Figure 2A:
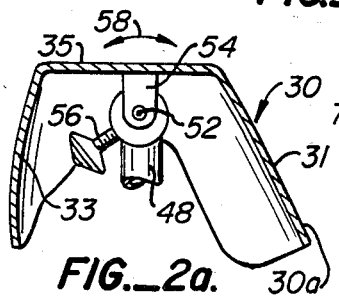
Figure 4:
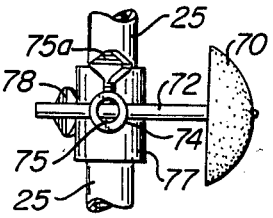
Figure 3:
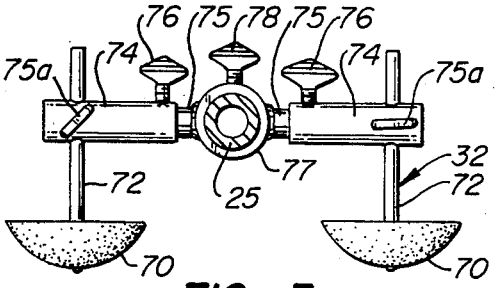
Figure 5:
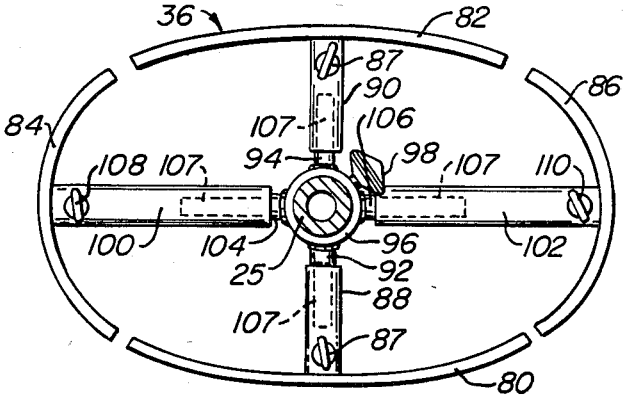
Figure 6:
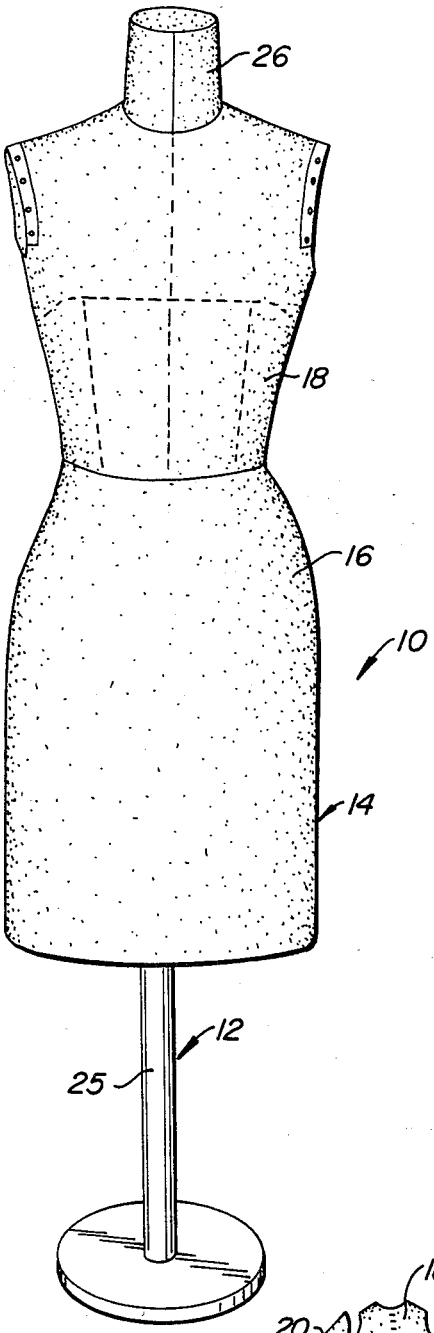
Figure 7:
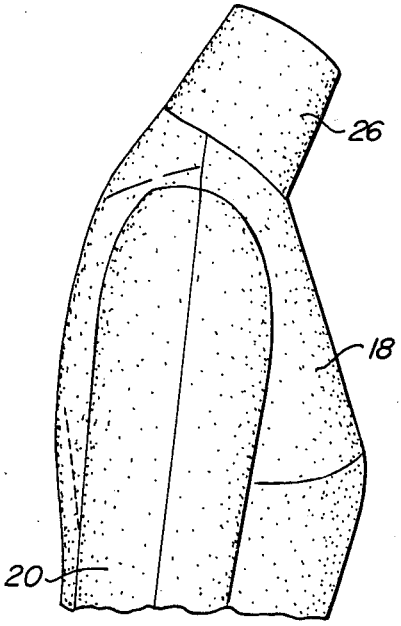
Figure 8:
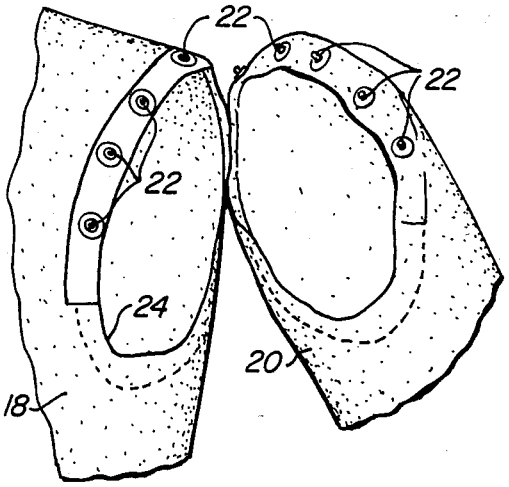
Figure 9:
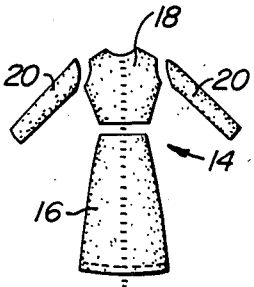

FIG. 2*a* is an enlarged, cross-sectional view of the neck and shoulder member;

FIG. 3 is an enlarged, cross-sectional view taken along line 3—3 of FIG. 1;

FIG. 4 is an enlarged, fragmentary side elevational view taken along line 4—4 of FIG. 1;

FIG. 5 is an enlarged, cross-sectional view taken along line 5—5 of FIG. 1;

FIG. 6 is a perspective view of the pattern form of the present invention, showing bodice and skirt pattern elements mounted on the adjustable members shown in FIG. 1;

FIG. 7 is an enlarged, fragmentary side elevational view of the bodice element of FIG. 6, showing an attached sleeve;

FIG. 8 is an enlarged, fragmentary front elevational view of the bodice element showing the way in which a sleeve is removably attached to it; and FIG. 9 is a schematic view showing the bodice, skirt and sleeve element for making the pattern form of the present invention.

The improved pattern form of the present invention is broadly denoted by the numeral 10 and is shown in FIG. 6. Pattern form 10 includes an interior structure 12 shown in more detail in FIGS. 1–5 and an exterior structure 14 which includes a skirt 16, a bodice 18 and, optionally sleeves 20 (FIGS. 7–9). The sleeves are shown as being long sleeves; however, they can be relatively short or omitted, if desired. FIG. 8 shows a number of snap fasteners 22 which are used to secure the upper ends of sleeves 20 to bodice element 18 at the sleeve openings 24 thereof. Other fastening means could be used, if desired. The bodice element 18 is also provided with a neck portion 26; however, this neck portion can be omitted, if desired.

The outer surfaces of skirt, bodice and sleeve elements provide the backing on which conventional garment patterns of tissue paper are to be mounted in making a garment. The tissue paper patterns can be pinned or otherwise attached to the outer surfaces of the pattern elements 16, 18 and 20 after the elements have been adjustably mounted on the inner structure which will be hereinafter described in detail. Thus, a typical set of pattern elements 16, 18 and 20 will typically be selected for a particular person although it is possible that such pattern elements 16, 18 and 20 can be re-adjusted to represent the body of a second person. Also, the pattern elements 16, 18 and 20 will be provided in various standard sizes in carrying out the teachings of the present invention. For a specific person, the standard size closest to the person's measurements will be selected for use in making pattern form 10.

The inner structure 12, shown in FIG. 1, defines the support for pattern elements 16 and 18. Structure 12 includes an upright post 25 mounted on a base 27. The post can be made up of several segments which can be telescoped to permit the post to be collapsed to reduce it length or expanded to increase its length. Any suitable structure for changing the length of the posts is within the scope of the present invention. Also, base 27 is separable from the bottom end of the post to simplify packaging and shipment.

Structure 12 has four adjustable members 30, 32, 34 and 36. Member 30 is adapted to provide the support for the neck and shoulder portions of bodice element 18. Member 30 is adjustable in shoulder length and in the angle of the shoulder with respect to the horizontal. The detail of member 30 is shown in FIGS. 1 and 2.

Member 30 includes a rigid sheet-like plastic body **30*a* which is shaped and formed to present a first, front segment 31, a rear segment 33, and a top segment 35. Segments 31 and 33 are slightly convex at their outer surfaces whereas segment 35 is substantially flat. A pair of side recesses 36 are provided in body 30*a* of member 30, and a pair of first, oval-shaped elements 37 are hingedly mounted by hinges 37*a* to body 30*a* at the side margins thereof within the recesses 36. The hinge axes are generally horizontal so that elements 37 can move up and down. An extension element 38 is adjustably mounted each oval element 37, respectively, and each extension element 38 has a generally convex outer surface. Moreover, each extension element 38 overlaps the adjacent oval element 37 and has a slot 39 which is open at its inner end. Each slot is adapted to receive a screw 40 having a head 41 and being coupled to a wing nut 42, whereby each extension element 38 can be adjustably mounted on the adjacent oval element 37 to thereby vary the length of the shoulder portion of member 30**.

The angle of droop of oval elements 37 can be varied by adjusting a pair of screws 44 which are threadably carried at the outer ends of a pair of side posts 46, the posts being secured at their inner ends to a tube 48 which is adjustably mounted by a set screw 50 on the upper end 52 of post 25. Screws 44 are inclined as shown in FIG. 1 to accommodate the slope of the lower surfaces of oval elements 37.

Body **30*a* can be adjusted for forward or rearward tilt by providing a pivotal shaft 52 at the upper end of tube 48. The pivotal shaft 52 mounts a pair of ears 54 secured to and extending downwardly from the inner surface of top segment 35 of body 30*a*. A set screw 56 adjustably positions body 30*a* with reference to the axis of shaft 52. Thus, adjustment of the forward or rearward tilt of body 30*a* can be in the direction of arrows 58 (FIG. 2*a***).

A neck element 60 (FIG. 1) can be provided on body **30*a*, if desired. Neck element 60 includes a circular flange 62 secured to the lower end of a sheet-like, generally flexible part 64 which can be placed in a cylindrical shape with the ends of part 64 overlapping each other. Flange 62 can be secured by Velcro strips 66 and 68 to the front and rear segments 31 and 33 of body 30*a*. Moreover, the overlapping ends of parts 64** can be provided with adjustment lines therein for different neck sizes. In this way, the styling of the collar can be shaped and the garment can have a neck opening which is of any desired size.

The bust member 32 is comprised of a pair of cup-shaped elements 70 secured to the outer ends of rods 72 adjustably secured in tubes 74 by set screws **75*a*. Each rod 72 may be provided with a calibrated scale on the underside thereof to allow for adjustment. This scale can be seen through a longitudinal slot in the underside of the adjacent tube 74. Tubes 74 are adjustably mounted on the outer ends of respective shafts 75 by set screws 76. Shafts 75 are secured to the opposite sides of a short tube 77 having a set screw 78 releasably securing it to post 25. Thus, each cup shaped element 70 can be adjusted by changing its fore and aft position, by changing its lateral spacing from post 25, and by changing its angle above and below a horizontal plane through shafts 75. Also, the height of cup shaped elements 70 can be adjusted by adjusting the position of short tube 77 along the length of post 25**.

Waist member 34 is of substantially the same construction as hip member 36 except that waist member 34 has a smaller circumference than member 36. Thus, a description of member 36 will suffice for the description of member 34.

Member 36 includes a pair of front and rear strips 80 and 82 and a pair of curved side strips 84 and 86. Strips 80 and 82 are secured at their center portions to relatively short tubes 88 and 90, these tubes being shiftably mounted on shafts 92 and 94 projecting forwardly and rearwardly from a short tube 96 adjustably mounted by a set screw 98 on post 25. Set screws 87 releasably secure tubes 88 and 90 to shafts 92 and 94.

Side strips 84 and 86 are secured to relatively longer tubes 100 and 102 which are shiftably mounted on shafts 104 and 106 projecting laterally from the opposed sides of short tube 96. Set screws 108 and 110 adjustably secure tubes 100 and 102 to shafts 104 and 106. Shafts 92, 94, 104 and 106 will be provided with longitudinal scales 107 (FIG. 5) for adjustment purposes. Tubes 88, 90, 100 and 102 have slots to view such scales.

Each of members 34 and 36 can, therefore, be adjusted in a number of different directions. For instance, hip member 36 can be adjusted to increase or decrease the circumference by changing the positions of tubes 88 and 90 along shafts 92 and 94 and by changing the positions of tubes 100 and 102 along shafts 104 and 106. Moreover, the height of member 36 can be adjusted by changing the position of tube 96 along the length of post 25. Member 34 can be adjusted in the same way as member 36.

The material used for pattern elements 16, 18 and 20 can be of any suitable, self-sustaining, generally rigid material. A suitable material for this purpose is pellon which is available commercially. This material is washable, can be pressed, and is non-shrinkable. It can be stitched on a seam line with a domestic sewing machine. It is also crushable when stored, but the creases caused by crushing can be pressed out with a steam iron. The pellon material can be handled in a manner such that, when pattern elements 18, 20 and 22 are supplied in kit form, such elements can be in standard sizes to facilitate the formation of pattern form 10.

In use, assuming pattern elements 18, 20 and 22 are previously made while possibly still requiring adjustment, inner structure 12 is erected and members 30, 32 and 34 and 36 are adjusted for neck size and shape, shoulder size and shape, bust size and shape, waist size and shape, and hip size and shape. Members 30, 32, 34 and 36 are all adjusted along the length of post 25 as to the height of a person for whom pattern form 10 is to be made and used.

Once the members 30, 32, 34 and 36 are adjusted, pattern elements 16 and 18 are then placed on such members to present pattern form 10 as shown in FIG. 6. Generally, it will not be necessary or desirable to make slight adjustments in the shapes of elements 16 and 18. Any minor adjustments will be made by adjusting any or several of the adjustable members of pattern form 10. Also, the skirt element is releasably coupled to the bodice element. When the pattern form is in the condition shown in FIG. 6, garment patterns of tissue paper can then be applied to pattern form 10 in the usual fashion.

The present invention provides an improvement over garment pattern forms of conventional construction and allows a garment to be made quickly and easily yet the garment will truly represent the actual measurements of the body of the person over a long period of time and such measurements can be easily changed as the body of the person increases or decreases in size.

What is claimed is:

1. A garment pattern form comprising: an upright post; first, second, third and fourth adjustable members shiftably mounted on the post, each member being spaced from and adjustable on the post independently of the other members and having means thereon for releasably securing the member to the post, the first member representing the shoulder region, the second member representing the bust region, the third member representing the waist region, and the fourth member representing the hip region, said members presenting outer surfaces; and flexible means removably mounted on the outer surfaces of the members for presenting surface portions on which tissue paper patterns can be mounted.

2. A pattern form as set forth in claim 1, wherein said presenting means comprises a number of pattern elements surrounding respective members and having outer surfaces defining said surface portions.

3. A pattern form as set forth in claim 2, wherein the pattern elements include a bodice element and a skirt element, the skirt element being removably secured to the bodice element.

4. A pattern form as set forth in claim 3, wherein the bodice and skirt elements are adjustable in size and shape.

5. A pattern form as set forth in claim 2, wherein the material of each pattern element is flexible to permit the element to be adjusted in size and shape in accordance with the adjustments of the members on said post.

6. A pattern form as set forth in claim 2, wherein the pattern elements are formed from pellon material.

7. A pattern form as set forth in claim 1, wherein the first member includes a generally rigid body having front and rear surface portions, and a pair of strips projecting laterally from opposed sides of the body, said strips representing the shoulders.

8. A pattern form as set forth in claim 7, wherein the strips are pivotally mounted on the body and are normally inclined, and means coupled with the strips for adjusting the angle of inclination of the strips.

9. A pattern form as set forth in claim 7, wherein each side strip has an extension part adjustably secured thereto and extending outwardly therefrom, whereby the length of each side strip may be adjustably changed.

10. A pattern form as set forth in claim 7, and including means coupled with the body for pivotally mounting the body for movement about a generally horizontal axis extending laterally from the post, and means coupled with the body for adjustably holding the same in any one of a number of operative positions about said axis.

11. A pattern form as set forth in claim 7, wherein is included means for defining an adjustable neck band, and means releasably coupling the neck band on the body.

12. A pattern form as set forth in claim 1, wherein the second member includes a pair of horizontally spaced, cup-shaped members, a pair of lateral shafts releasably secured to and extending from said post in opposite directions, and means adjustably securing each cup-shaped member to a respective shaft to permit fore and aft and angular adjustments of each cup-shaped member relative to the shaft and to permit adjustment of the cup-shaped member along the length of the shaft.

13. A pattern form as set forth in claim 12, wherein each cup-shaped member has a rod secured to and extending outwardly from the interior thereof, said securing means including a tube for each shaft, respectively, each tube being rotatably and axially shiftable relative to the respective shaft, means releasably securing each tube to its respective shaft, and means securing each rod to a respective tube.

14. A pattern form as set forth in claim 1, wherein each of the third and fourth members comprises a number of shafts, means adjustably mounting the shafts on the post to cause the shafts to extend generally radially and horizontally outwardly from the post, a strip for the outer end of each shaft, respectively, and means adjustably mounting each strip on the respective shaft for movement axially of the shaft.

15. A pattern form as set forth in claim 14, wherein each strip is curved.

16. A pattern form as set forth in claim 14, wherein is provided four strips, each strip being formed from a bendable, relatively self-sustaining material.

17. A pattern form as set forth in claim 15, wherein said securing means comprises a tube rigidly secured to each strip, respectively, each tube being telescoped over a respective shaft, and a set screw on each tube for bearing against the adjacent shaft.

18. A pattern form as set forth in claim 1, wherein the length of the post is adjustable.

* * * * *